US005562291A

United States Patent [19]

Garcia

[11] Patent Number: 5,562,291

[45] Date of Patent: Oct. 8, 1996

[54] ARROW TIP FOR SHOOTING WOODEN TARGET

[75] Inventor: Daniel D. Garcia, 12807 Maple Park, San Antonio, Tex. 78249

[73] Assignee: Daniel D. Garcia, San Antonio, Tex.

[21] Appl. No.: 535,648

[22] Filed: Sep. 28, 1995

[51] Int. Cl.[6] ..... F42B 6/08

[52] U.S. Cl. ..... 273/419

[58] Field of Search ..... 273/419–422

[56] References Cited

U.S. PATENT DOCUMENTS 2,613,936 10/1952 Dalton ..... 273/419
2,848,834 5/1957 Cox ..... 43/1
2,989,310 9/1959 Lamond ..... 273/106.5
4,268,038 11/1979 Hopkins ..... 273/416
5,022,658 12/1989 Burkhart ..... 273/416

*Primary Examiner*—Paul E. Shapiro

[57] ABSTRACT

An arrow tip for shooting wooden targets with an archery arrow and retrieving said arrow and said arrow tip from said wooden target. The arrow tip having, a penetrating point forward of, a cylindrical shank forward or aft of, a circular cutting edge forward or aft of, a left-handed extraction thread forward of, a post extraction tip removal hole forward of, a circular curing edge as large or larger than an arrow shaft. The arrow tip is removed by rotating and pulling same.

1 Claim, 3 Drawing Sheets

ARROW TIP FOR SHOOTING WOODEN TARGET

BACKGROUND-FIELD OF INVENTION

This invention relates to archery arrows specifically intended for shooting at wooden targets (e.g. stumps, trees, lumber, etc.). This practice is often referred to as stump shooting or stump hunting. The invention incorporates a specific arrow tip retrieval method.

BACKGROUND-DESCRIPTION OF PRIOR ART

Archery arrows have two basic types of arrow tips, a target tip or a game tip. The target tip is generally designed to shoot foam targets or bales of hay. The game tip is generally designed to kill game animals, such as deer, bear, hogs, turkey and other legal game animals. The following types of arrow tips are designed with stopping or braking systems.

U.S. Pat. No. 5,022,658 Arrow Penetrator Brake Assembly is commonly referred to as a Judo point or a Grasshopper. The Judo point has a blunt tip where the Grasshopper is used in conjunction with a broadhead. Both feature spring arms that snag on brass, brush or the ground on impact. The spring arms are intended to minimize the arrow's travel after impact and thus reduce arrow loss. Due to the short blunt tip of the Judo point it generates very high impact forces. These impact forces are often high enough to bend, shatter or split the arrow shaft. Should the Judo point or Grasshopper become completely imbedded in a wooden target it is very difficult to remove.

U.S. Pat. No. 2,848,834 Humane Hunting Arrow uses a net attached to the arrow shaft to prevent the arrow from completely penetrating the target. This device requires that the majority of the arrow penetrate the target for the device to be effective. It is unusual for the majority of the arrow to penetrate a wooden target without arrow damage, as the first few inches of penetration exhibit the highest stopping forces. Furthermore, the device does not aid in the removal of the arrow or arrow tip. The added weight of the device and aerodynamic drag of the net would significantly effect the arrow's flight characteristics.

U.S. Pat. No. 4,268,038 Accessory for an Arrow employs a braking device. The device is a spring coil wrapped around the arrow shaft leading back from the tip. This coil unwinds upon sufficient penetration of the target, which requires that the entire tip of the arrow must penetrate the target before the device can be engaged. This creates high stopping forces, which increases the possibly of arrow damage and does not aid in the removal of the arrow after impact.

U.S. Pat. No. 2,989,310 Arrow Brake and Indicator Devices uses a slender spike at the forward end of the arrow for stopping. Sufficient penetration of the arrow into a women target would damage the device. This invention does not provide a positive means of removal after impact, thus damage to the arrow may occur upon removal of the arrow or arrow tip.

The afore mentioned designs are intended for shooting game animals and provide insufficient protection for the arrow shaft if used for wooden targets or stump shooting. Therefore many arrow shafts may be damaged or destroyed, while using the afore mentioned designs. This damage to the arrow discourages an archer from shooting at wooden targets. The arrow damage is generally created by the high forces involved in the impact of the arrow. To diminish these forces the arrow must be stopped over a greater distance. Damage to the arrow may also occur during removal of the arrow or tip, therefore the following design is to aid in removal of the arrow or arrow tip.

OBJECTS AND ADVANTAGES

Accordingly, several objects and advantages of my invention are as follows:

a) Allow archers to shoot arrows at wooden targets and have the arrow retained at the impact point to determine the accuracy of the shot.

b) Provide a means of shooting wooden targets that will minimize arrow damage.

c) Provide an easy method of removal of the arrow and arrow tip from the wooden target after impact.

d) Provide hunters with targets other than game animals, foam targets or hay bales which will provide more opportunities to take practice shots to verify and improve accuracy.

e) Reduce the cost of stump shooting by minimizing damage to arrows.

f) Provide an arrow tip that does not significantly alter the flight characteristics of the arrow.

DRAWING FIGURES

Reference Numerals In Drawings

10- Penetrating Point
12- Deceleration Shank
14- Cutting Shoulder
16- Deceleration Shank
18- Cutting Shoulder
20- Extractor Threads
22- Cutting Shoulder
24- Puller Removal Hole
26- Arrow Shaft Cutting Shoulder
28- Anchor Threads
30- Arrow Shaft (not part of invention)
32- Puller (not part of invention)

DESCRIPTION OF FIGS. 1 AND 2

Figure 1:
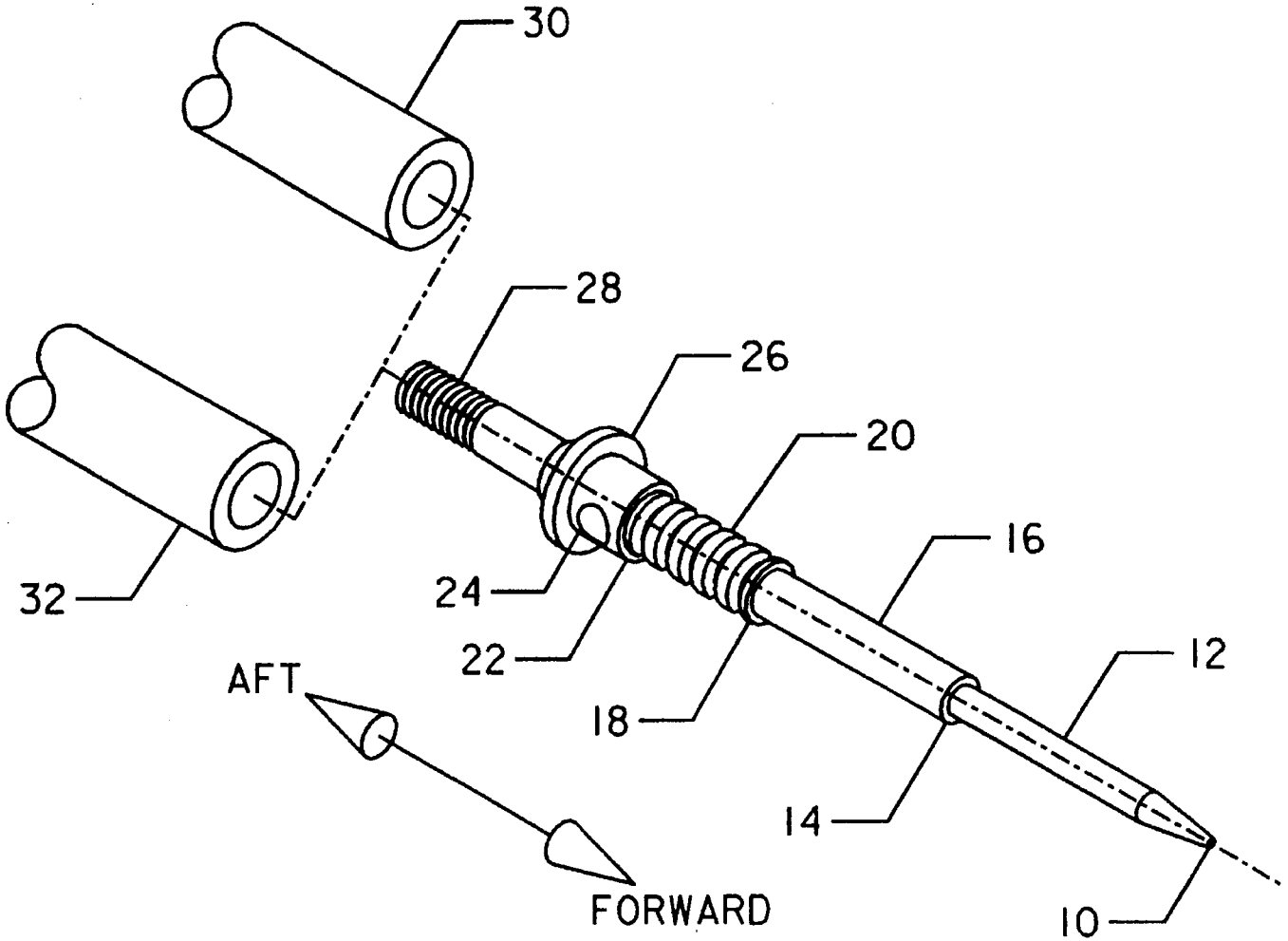
FIG. 1 is a perspective view of my invention seen with the forward most part of the arrow tip in the FORWARD direction and the rear most part being the AFT direction.
Figure 2:
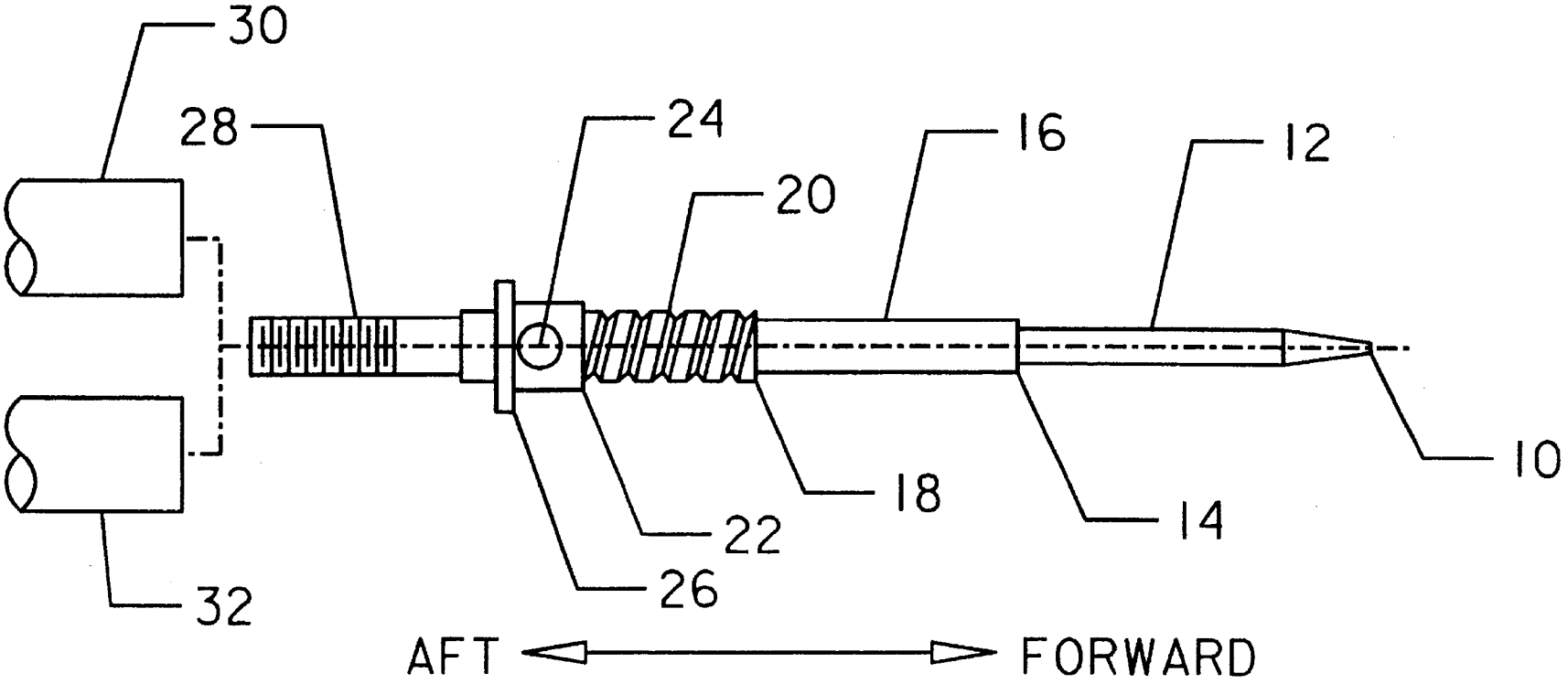
FIG. 2 is a side view of my invention seen with the forward most part of the arrow tip in the FORWARD direction and the rear most part being the AFT direction.

A typical embodiment of the arrow tip is seen in FIG. 1 and FIG. 2. The arrow tip is for the most part radially symmetrical about a longitudinal centerline. At the forward most part is a Penetrating Point 10 which provides initial penetration on impact and may be tapered to a fine point. Immediately aft of Penetrating Point 10 is a Deceleration Shank 12 which has the same or larger diameter than the base of Penetrating Point 10. Deceleration Shanks in general are long cylindrical section, which may be used several times along the length of the arrow tip. Deceleration Shank 12 and 16 are typical of Deceleration Shanks. Immediately aft of Deceleration Shank 12 is a Cutting Shoulder 14. Cutting Shoulder 14 is larger in diameter than Deceleration Shank 12. Cutting Shoulders in general form a flat forward facing surface with a sharp corner at the outside diameter and may be used several times along the length of the arrow tip. Cutting Shoulder 14, 18, and 22 are typical of Cutting Shoulders. Immediately aft of Cutting Shoulder 18 is an Extractor Thread. 20. Extractor Thread 20 is a coarse deep grooved left-handed thread, which is used to remove the arrow tip from the target. Aft of Extractor Thread 20 is a Puller Removal Hole 24. Puller Removal Hole 24 is a hole drilled through the center of the arrow tip and is intended to accept a tool to aid in the removal of the arrow tip from a Puller 32. Immediately aft of the Puller Removal Hole 24 is the Arrow Shaft Cutting Shoulder 26. Arrow Shaft Cutting Shoulder 26 is typical of Cutting Shoulders with the exception that the outside diameter of Arrow Shaft Cutting Shoulder 26 is as large or larger than the diameter of Arrow Shaft 30. The portion of the arrow tip aft of the Arrow Shaft Cutting Shoulder 26 is typically inside of the Arrow Shaft 30 or Puller 32 when the arrow tip is seated properly. Aft of the Arrow Shaft Cutting Shoulder 26 is an Anchor Thread 28. Anchor Thread 28 is a fine standard right-handed thread that is a typical method of attaching arrow tips to arrow shafts. In FIG. 1 and FIG. 2 Arrow Shaft 30 or Puller 32 represents the item that the arrow tip is attached to during shooting and removal of the arrow tip from the target.

Operation

The manner of use of my invention is as follows: The Arrow Tip for Shooting Wooden Targets is attached to the forward end of an arrow shaft in a typical manner by screwing Anchor Thread 28 into the insert provide by the arrow shaft. The tip is finger tightened to insure that the arrow tip is seated properly. The arrow is then drawn in a bow and shot in the normal manner with the exception being that the target is a wooden target. As the arrow impacts the target, Penetrating Point 10 first contacts the target. Penetrating Point 10 provides initial penetration and prevents the arrow from being deflected as deflection can result in arrow damage. As the arrow penetrates further into the target, Deceleration Shank 12 and 16 come in contact with the target. Deceleration Shank 12 and 16 provide slowing of the arrow by means of friction with the wooden target. As Cutting Shoulder 14, 18 and 22 come into contact with the target, the sharp comers of the outer diameter cut the grain of the wood. This results in the cut wood being pushed further into the target, which provides enhanced deceleration and prevents the arrow tip from becoming wedged in the target. As the arrow penetrates further into the target, Extractor Thread 20 passes into the target. Extractor Thread 20 has a primary function to remove the arrow tip from the target, but it also provides friction with the target and thus provides deceleration. Should the arrow tip not penetrate to Extractor Thread 20 the force of impact is minimized, which will aid in removal. As Arrow Shaft Cutting Shoulder 26 contacts the target, it makes a hole that is as large or larger than Arrow Shaft 30. This allows Arrow Shaft 30 to be removed from the imbedded arrow tip without any special tools. Simply grip Arrow Shaft 30 and unscrew in a counter-clockwise direction. Arrow Shaft 30 could be turned in a clockwise direction to remove the imbedded arrow tip, however Arrow Shaft 30 is often too slender to firmly grip and induce sufficient torque to turn the imbedded arrow tip. Puller 32 is required to provide sufficient torque to turn the imbedded arrow tip. Screw Puller 32 onto the imbedded arrow tip by turning Puller 32 clockwise until it seats firmly on the arrow tip. Then continue turning Puller 32 in a clockwise direction and the imbedded arrow tip will begin to turn. As the arrow tip turns clockwise, Extractor Thread 20 will move the arrow tip out of the target. A turning- pulling action will aid in the removal of the arrow tip from the target. After the arrow tip is removed from the target, a slender shaft, rod or another arrow tip can be placed through Puller Removal Hole 24 and can be used to remove the arrow tip from Puller 32. This is usually necessary as the arrow tip is tighter than finger tight.

SUMMARY

Accordingly, the reader can see that the arrow tip for shooting wooden targets will provide bow-hunters as well as target shooters an alternative to the items they are presently shooting. This invention can minimize arrow damage and allow arrow tip retrieval. The invention will also help archers by allowing a broader range of target types, thus improving accuracy and productivity.

The invention can be made from a variety of materials. The best material to be used to manufacture an arrow tip for shooting wood is steel. Many varieties of steel are readily machinable and can be heat treated to high strengths. Ease of machining will reduce manufacturing cost, while the high strength of steel is preferred to withstand the great forces during impact of the arrow.

Most stainless steels have excellent strength and are readily machined and would make an arrow tip comparable to that of steel. Stainless steel is typically more costly than steel and would therefore increase the final price of the product.

Another material that could be used is aluminum. Aluminum is easily machined and thus will have reduced manufacturing costs. Aluminum can also be heat treated to improve its strength, however its maximum strengths are typically less than that of steel or stainless steel. Aluminum has a lower density than steel, thus the arrow tip must be made larger if it is made of aluminum. A longer arrow tip will reduce impact forces, while a larger diameter will increase impact forces.

Brass might also be used. Brass is easily machined and thus will have reduced manufacturing costs, however brass is typically more costly than other common metals. Brass has a higher density than most common metals, but does not have improved strength for this added weight and is therefore considered a low performance structural material. An arrow tip made of brass would be heavy and limited to use with softer woods.

Titanium has excellent strength and is one of the lighter common metals. An arrow tip made of titanium could be made longer and thus reduce impact forces. Titanium is costly and difficult to machine, which will increase manufacturing costs.

Other metals such as inconel, tungsten, nickel, cobalt, copper, tin, bronze, lead, magnesium, monel, zinc could be used to made an arrow tip, but many of these metals are either costly or have inferior strength. Thus an arrow tip made of these metals would be expensive and/or be limited to special uses.

The configuration of this invention might also be rearranged in a variety of manners and would still provide reasonable performance.

Figure 3:
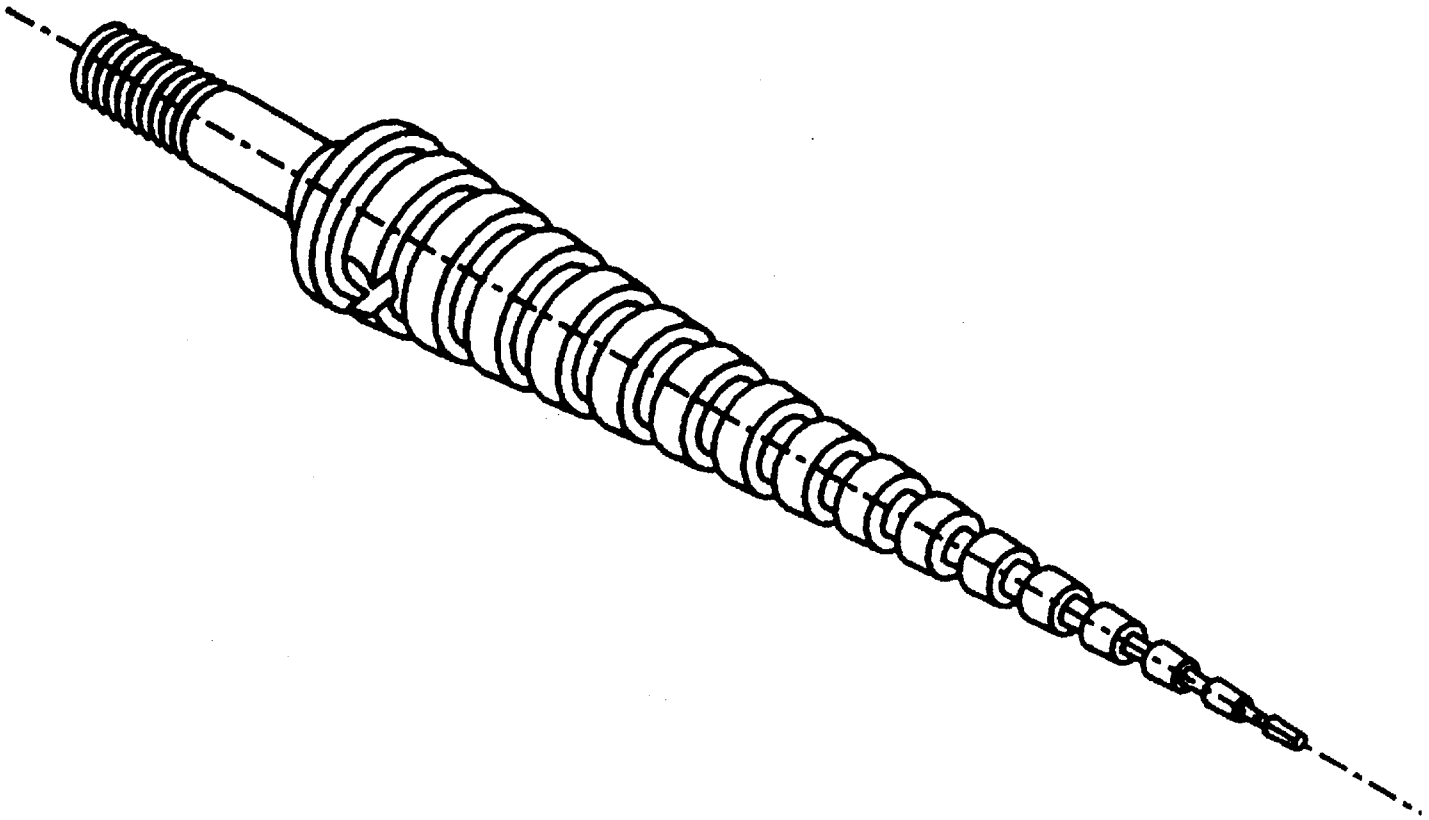
FIG. 3 is a perspective view of an alternate embodiment of my invention.

The extractor thread of the design can be lengthened and tapered to a smaller diameter as it nears the forward end of the arrow tip, as seen in FIG. 3. This would allow the cutting shoulder to be removed. The arrow tip on impact would be wedged in the wood, but can be removed by means of the extractor threads.

More cutting shoulders can be added to the design, which will increase the number of deceleration shanks. This will allow the extractor thread to be omitted from the design. This will change the impact characteristics and will make the arrow tip more difficult to remove from the target. While the arrow tip will not be wedged in the wood, additional pulling force via the puller will be required as the arrow tip is turned to remove the arrow tip.

The puller removal hole may be deleted entirely. This will require that a tool (such as pliers) be used to remove the arrow tip from the puller. The use of a tool such as pliers may disfigure the arrow tip and impair the performance of the arrow tip.

An alternate method of attaching the arrow tip to the arrow shaft may be used. An adhesive or banquet mount may be used to attach the arrow tip to the arrow shaft, however this would require that the arrow shaft be made to accept the alternate mounting method. Most arrow shafts are designed to accept threaded tips. The anchor threads may also be deleted entirely, leaving only a stem to mount in the arrow shaft. This would result in the arrow shaft separating from the arrow tip on impact. It would also require a special puller to remove the arrow tip.

Thus the scope of the invention should be determined by the appended claims and their legal equivalents, rather than by the examples given.

I claim:

1. An arrow tip for shooting wooden targets comprising;

a) A leading penetrating section tapering along an axis from a largest diameter rear end to a point for initial penetration of the target, b) a first constant diameter cylindrical deceleration shank adjoining and extending coaxially with and rearwardly from the rear end of the penetrating section, the diameter of the deceleration shank being at least as great as the largest diameter of the penetrating section, c) at least one additional constant diameter deceleration shank adjoining and extending coaxially with and rearwardly in sequence from the rear of the first deceleration shank, the diameter of each such shank being greater than the diameter of the preceding shank in sequence, d) an extractor shank adjoining and extending coaxially with and rearwardly from one of the additional deceleration shanks, the extractor shank having a helically grooved surface and a diameter which is greater than any preceding deceleration shank and less than any following deceleration shank and, e) a cutting shoulder lying in a plane perpendicular to the axis at the junction of each adjoining pair of shanks, and f) a cylindrical mounting shank adjoining and extending coaxially with and rearwardly from the rearmost preceding shank, the mounting shank having a diameter less than the diameter of the shank from which it extends.

* * * * *